US007049965B2

(12) United States Patent
Kelliher et al.

(10) Patent No.: US 7,049,965 B2
(45) Date of Patent: May 23, 2006

(54) SURVEILLANCE SYSTEMS AND METHODS

(75) Inventors: Timothy Patrick Kelliher, Scotia, NY (US); Jens Rittscher, Schenectady, NY (US); Peter Henry Tu, Schenectady, NY (US); Kevin Chean, Troy, NY (US); Harold Woodruff Tomlinson, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 77 days.

(21) Appl. No.: 10/677,207

(22) Filed: Oct. 2, 2003

(65) Prior Publication Data

US 2005/0073418 A1 Apr. 7, 2005

(51) Int. Cl.
*G08B 13/14* (2006.01)

(52) U.S. Cl. ..... 340/572.4; 340/572.7; 340/572.1; 340/745; 340/748; 340/10.31; 342/125; 342/126; 342/127

(58) Field of Classification Search ..... 340/572.4, 340/572.7, 572.1, 745, 748, 10.42, 10.31; 342/125, 126, 127
See application file for complete search history.

(56) References Cited

U.S. PATENT DOCUMENTS

| | | | | |
|---|---|---|---|---|
| 5,247,261 | A | 9/1993 | Gershenfeld | |
| 5,558,091 | A | 9/1996 | Acker et al. | 600/424 |
| 5,745,036 | A | 4/1998 | Clare | |
| 5,955,971 | A * | 9/1999 | Uemura | 340/947 |
| 6,028,626 | A | 2/2000 | Aviv | |
| 6,218,941 | B1 | 4/2001 | Cromer et al. | |
| 6,703,935 | B1 * | 3/2004 | Chung et al. | 340/572.7 |
| 2002/0175805 | A9 * | 11/2002 | Armstrong et al. | 340/10.31 |
| 2004/0236193 | A1 * | 11/2004 | Sharf | 600/302 |

* cited by examiner

*Primary Examiner*—Tai T. Nguyen
(74) *Attorney, Agent, or Firm*—Fletcher Yoder

(57) ABSTRACT

Surveillance systems and methods having both a radio frequency component and a video image are provided. The radio frequency component can determine the orientation and position of an RFID tag within a surveillance area. The orientation of the RFID tag is can be determined with respect to two or more orthogonal planes using inductance and a predetermined number of mutually orthogonal antenna loops.

16 Claims, 5 Drawing Sheets

SURVEILLANCE SYSTEMS AND METHODS

BACKGROUND

The present disclosure generally relates to surveillance systems and methods. In particular, the present disclosure relates to surveillance systems and methods that combine video and radio frequency identification.

Shoplifting prevention and inventory control are becoming more important to many commercial retail stores as way to minimize loses. Surveillance systems and methods are often used to achieve the desired reduction in losses.

Video surveillance systems are a common tool used in the efforts to prevent shoplifting and control inventory. Typical video surveillance systems use one or more cameras to survey an area. This allows a security officer to track a potential shoplifter through a shopping area, which is in the line of sight of the camera. Unfortunately, such video surveillance systems alone have not proven effective at achieving the desired reductions in shoplifting at an acceptable cost.

Radio frequency identification (RFID) systems are also becoming commonplace in the efforts to prevent shoplifting and control inventory. Advantageously, RFID does not require direct contact or line-of-sight scanning as in video surveillance systems. RFID systems incorporate the use of a tag and a scanner. The tag can emit electromagnetic or electrostatic signal in the radio frequency (RF) portion of the electromagnetic spectrum. The tag can then be placed on an object, animal, or person to uniquely identify that item. The scanner can detect the presence or absence of the emitted signal. RFID is sometimes called dedicated short-range communication (DSRC) since the emitted signal can be detected by the scanner within about a one-meter radius. Accordingly, many retail outlets have installed scanners at the points of entry and/or exit and include the tag on a piece of merchandise. In this manner, any merchandise having an active RFID tag will be detected as the item passes the scanner. The retail outlet can selectively deactivate and/or remove the tag of items that are approved to exit the area, such as those purchased by a customer. Unfortunately, such RFID systems alone have also not proven effective at achieving the desired reductions in shoplifting at an acceptable cost.

Accordingly, there is a continuing need for surveillance systems and methods that overcome and/or mitigate one or more of the aforementioned and other deficiencies and deleterious effects of prior systems and methods.

SUMMARY

A surveillance system having a video subsystem, a radio frequency identification subsystem, and a processor is provided. The video subsystem detects a video image of a tagged item. The radio frequency identification subsystem detects a position of the tagged item. The processor communicates with the video and radio frequency subsystems to monitor a condition of the tagged item based at least in part on the video image and the position.

A surveillance system having a first loop antenna, a second loop antenna, and a signal processor. The second loop antenna is substantially orthogonal to the first loop antenna. The first and second loop antennas are inductively couplable with a tag through magnetic fields. The signal processor estimates an orientation of said tag based on the magnitude of the inductively coupled modulated signal from the tag as the orientation of the coupling field generated from the first and second loop antennas is scanned through a range of angles.

A surveillance method is also provided. The method includes determining an orientation of an RFID tag, determining a position of the RFID tag; and providing the orientation and the position to a video-processing component.

BRIEF DESCRIPTION OF THE DRAWINGS

These and other features, aspects, and advantages of the present disclosure will become better understood with reference to the following description, appended claims, and drawings where:

DETAILED DESCRIPTION

Figure 1:
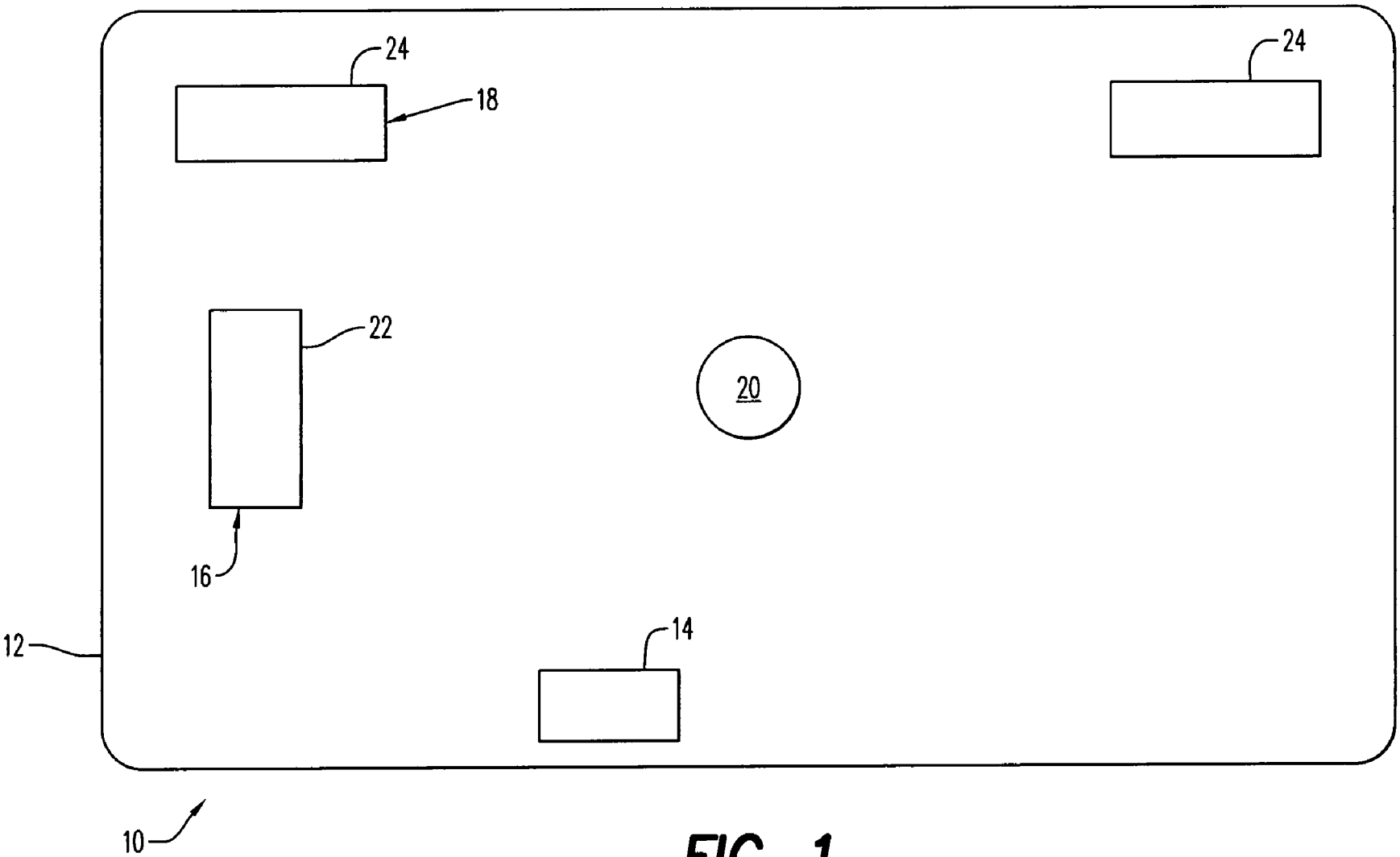
FIG. 1 is a block diagram of an exemplary embodiment of a surveillance system.

Referring now to FIG. 1, an exemplary embodiment of a surveillance system 10 in use in a surveillance area 12 is illustrated. System 10 includes a processor 14 for integrating a radio frequency identification (RFID) subsystem 16 and a video subsystem 18. System 10 integrates subsystems 16, 18 to track and provide information about an RFID tagged item 20 within area 12.

RFID subsystem 16 includes a number or plurality of scanners 22 at predetermined locations within area 12. Similarly, video subsystem 18 includes a number or plurality of cameras 24 at predetermined locations within area 12. Scanners 22 and cameras 24 are in electrical communication with processor 14 so that surveillance system 10 can integrate data received from the scanners and cameras to provide enhanced surveillance of item 20.

Scanners 22 can detect RFID tagged item 20 when the item is within about a one-meter radius. Cameras 24 can detect RFID tagged item 20 when it is within the field of view of one of the cameras. Advantageously, surveillance system 10 is configured to track tagged item 20 using scanners 22 when with the detection range of the scanners, but using cameras 24 when with the field of view of the cameras. System 10 can automatically switch its surveillance of tagged item 20 between scanners 22 and cameras 24 within area 12 as the item is moved throughout the area. In this manner, system 10 can determine the position of tagged item 20 within a surveillance area 12.

It has been determined that it can be more difficult to discriminate between casual behavior and theft with only position information. Without knowing the orientation of tagged item 20, it can be difficult to recognize desired information about the tagged item when viewed by cameras 24. Accordingly, system 10 is configured to determine the orientation of tagged item 20 within surveillance area 12.

For example, some customer behavior with respect to tagged item 20 cannot be detected under certain conditions of system 10, such as when the tagged item is partially outside the field of cameras 24. It has been found that combining the position and orientation of tagged item 20 from RFID subsystem 16 with the video from video subsystem 18 allows surveillance system 10 to efficiently predict an expected appearance of the tagged item. Here, surveillance system 10 can then compare the expected appearance to an actual video image to detect authorized tampering.

Figure 2:
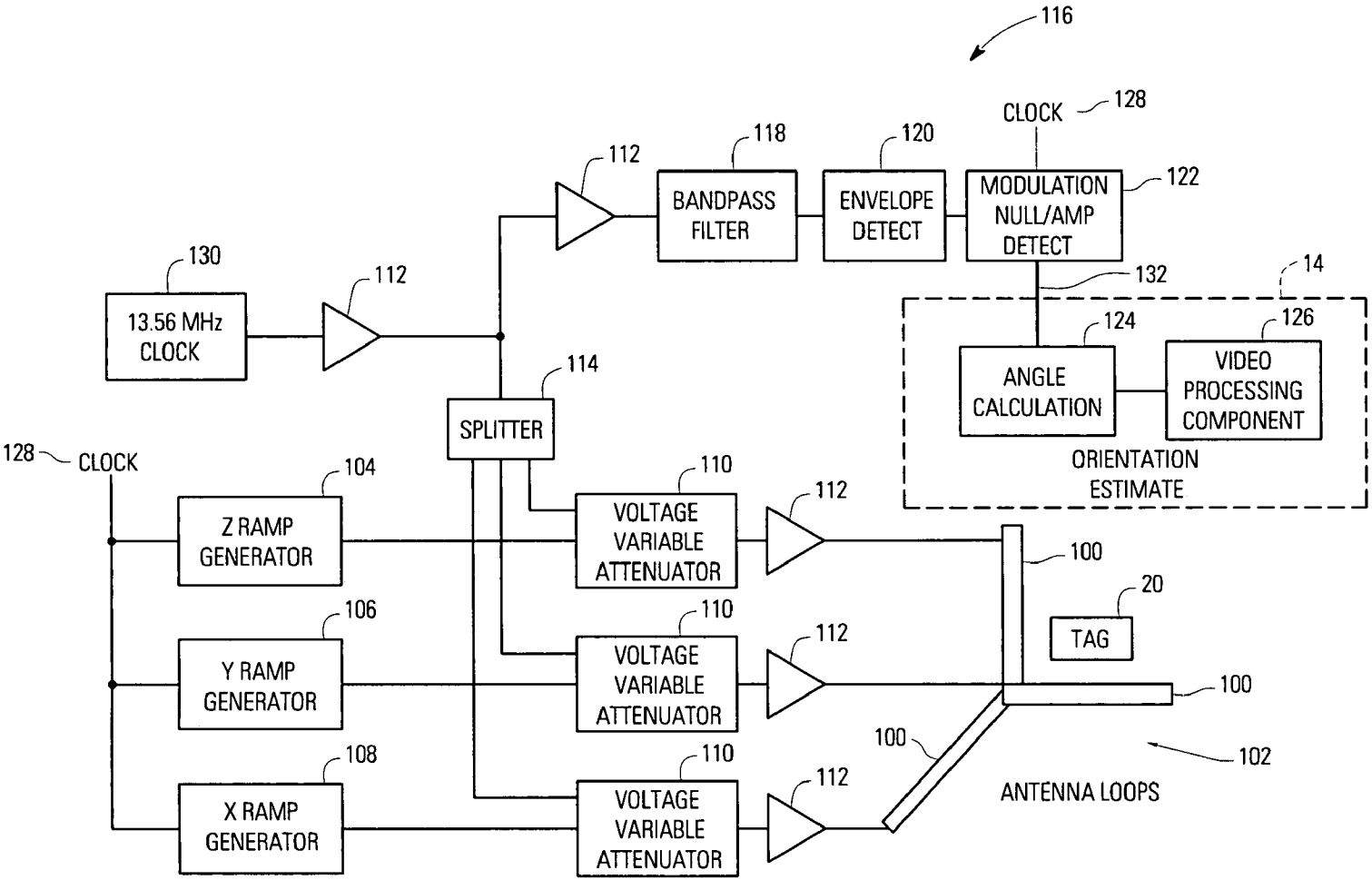
FIG. 2 is a block diagram of relevant portions of a radio frequency identification subsystem.

Referring now to FIG. 2, an exemplary embodiment of scanner 22 of RFID subsystem 16 is illustrated. Scanner 22 includes three loop antennas 100 are arranged substantially orthogonal to one another.

Loop antennas 100 are driven by a z ramp generator 104, a y ramp generator 106, and an x ramp generator 108, respectively, through voltage variable attenuators 110 and amplifiers 112. Antennas 100 receive signals indicative of tagged item 20. These received signals are summed through a splitter 114 and are sent to a receive chain 116.

It should be recognized that scanner 22 is illustrated by way of example having three loop antennas 100. Of course, it is contemplated by the present disclosure for each scanner 22 to have less than three loop antennas 100. For example, it is contemplated for scanner 22 to have two loop antennas 100.

Loop antennas 100 can be any loop antenna, such as the Texas Instruments (TI) Series 6000 Gate Antenna RI-ANT-T01. This TI gate antenna is used with readers having a transmitter frequency of 13.56 MHz and an output impedance of 50 Ohm, such as the TI S6500/6550 Readers.

Tagged item 20, in this example, includes an inductive passive tag capable of being read by loop antennas 100 when the tagged item 20 is within an interrogation zone 102 of scanner 20. Interrogation zone 102 can be about one meter in each direction from loop antennas 100. ISO Standard 15693-2, a communications protocol, defines one method for reading data from inductive passive tags. In this example, tagged item 20 is inductively coupled with magnetic fields through loop antennas 100.

Z ramp generator 104, y ramp generator 106, and x ramp generator 108 control the amplitude of the 13.56 MHz RF antenna excitation waveform for antennas 100 by way of a ramp waveform. For example, ramp generator 104, 106, 108 can be the Agilent Technologies 33220A Function/Arbitrary Waveform Generator. Attenuator 110 is a device for reducing the amplitude of an AC wave without introducing appreciable distortion. Amplifier 112 is an electronic device that increases the voltage, current, and/or power of a signal. Splitter 114 is a device that divides a signal into two or more signals, each carrying a selected frequency range, or reassembles signals from multiple signal sources into a single signal. An example of splitter 114 is Mini-Circuit's power splitter ZSC-2-1.

Receive chain 116 is a signal processing component that includes, for example, a bandpass filter 118, an envelope detector 120, a modulation minimum (null) detector 122, and an angle calculator 124. In some embodiments, there is a receive chain for each loop antenna 100. The resulting orientation calculated by angle calculator 124 is provided to a video processing component 126.

Bandpass filter 118 is an electronic device or circuit that allows signals between two specific frequencies to pass, but that discriminates against signals at other frequencies. An example bandpass filer 118 has a filter passband of 13.98375 MHz±50 KHz. Envelope detector 120 detects the envelope (upper and lower bounds) of the waveform as described in detail below with respect to FIG. 4.

Modulation minimum detector 122 finds the point at which the envelope is at a minimum (null). The tag modulation minimum indicates a magnetic field is at substantially right angles to tagged item 20. Angle calculator 124 determines the orientation of tagged item 20. At certain times during the antenna excitation, the magnitude of the tag modulation signal as received by a single antenna can be measured. The measurements for the X, Y, and Z antenna can be used with the orientation of the tagged item to determine the position of the tagged item in the interrogation zone of the antenna.

Video processing component 126 is provided by video subsystem 18 to processor 14. Video subsystem 18 is any video system capable of tracking tagged item 20, such as merchandise, in area 12. In one embodiment, video processing component 126 comprises a tracking mechanism, an object verification mechanism, and a recognition mechanism. The tracking mechanism tracks people and objects. The object verification mechanism verifies tag information with video images. The recognition mechanism recognizes patterns in the video images.

After receiving the orientation from RFID subsystem 16, processor 14 is able to use the orientation of tagged item 20 to compare the video image of the object to the expected appearance of the object at that orientation. As a result, some tampering and shoplifting is detectable.

Processor 14 can communicate with subsystems 16, 18 by known communication methods such as, but not limited to, as Ethernet. Here, video processing component 126 includes software components, such as segmentation routines, temporal association routines, geometric reconstruction routines, RFID object detection, RFID position and orientation detection, object tracking, person tracking, behavior analysis, probabilistic engines, and Bayesian frameworks.

In some embodiments, video processing component 126 activates RFID subsystem 16 when a person is within interrogation zone 102 of scanner 20. If a person is in zone 102 with tagged item 20, the person changes the magnetic coupling between tagged item 20 and loop antennas 100 by virtue of their body being present in the magnetic field. System 10 is configured to detect these changes the magnetic coupling between tagged item 20 and loop antennas 100 by virtue of their body being present in the magnetic field.

A 13.56 MHz clock signal 130, and other clock signals 128 are included in example subsystem 16, which has a frequency of 13.56 MHz. In some embodiments one or more of clock signals 128 is a frame rate clock from video processing component 126.

Figure 3:
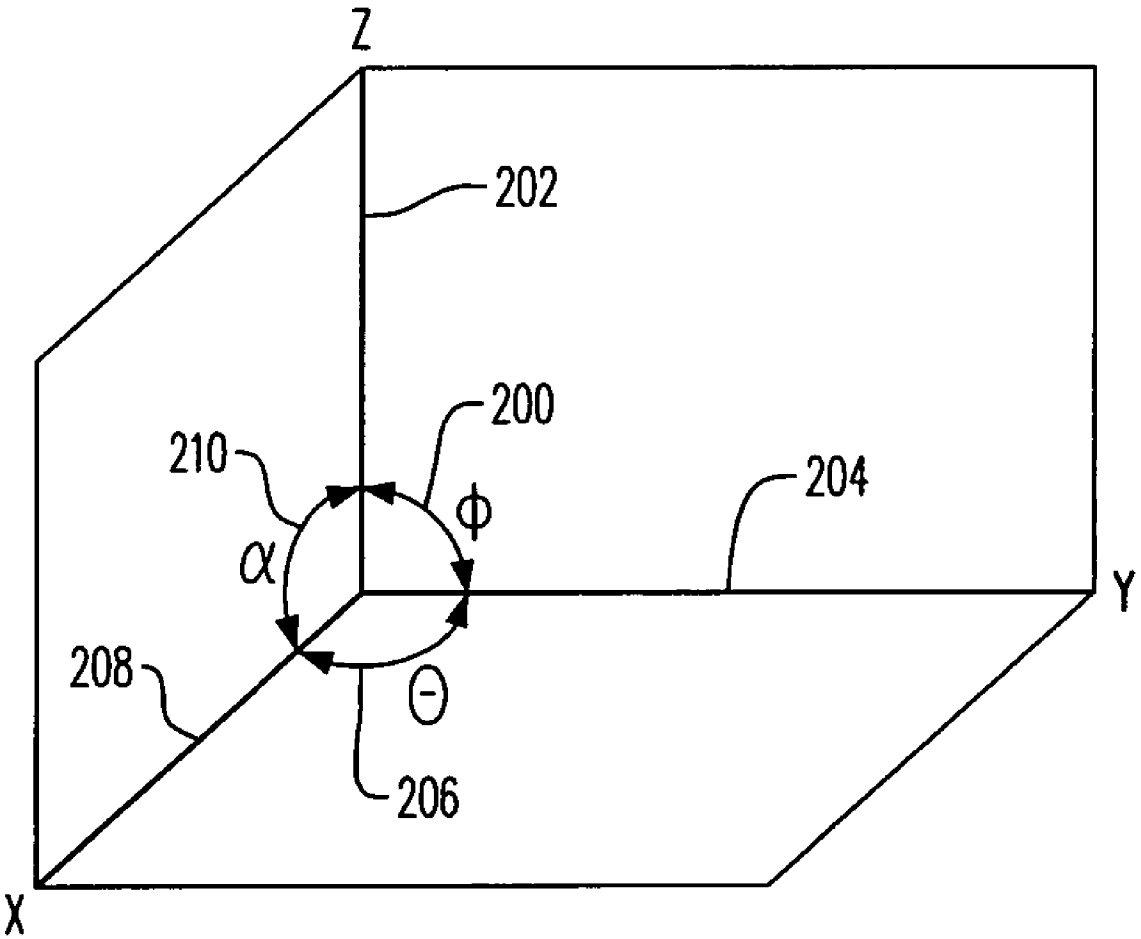
FIG. 3 is an illustration of an example orientation measurement.

Referring now to FIG. 3, an exemplary orientation and position measurements relative to three axes is illustrated. The orientation is calculated by angle calculator 124. The orientation is a triple, ($\Phi$, $\alpha$, $\theta$) where $\Phi$ (phi) 200 is the angle measured from the z-axis 202 to the y-axis 204, $\theta$ (theta) 206 is the angle measured from the y-axis 204 to the x-axis 208, and $\alpha$ (alpha) 210 is the angle measured from the x-axis 208 to the z-axis 202. In some embodiments, the orientation is a single angle relative to two axes.

Figure 4:
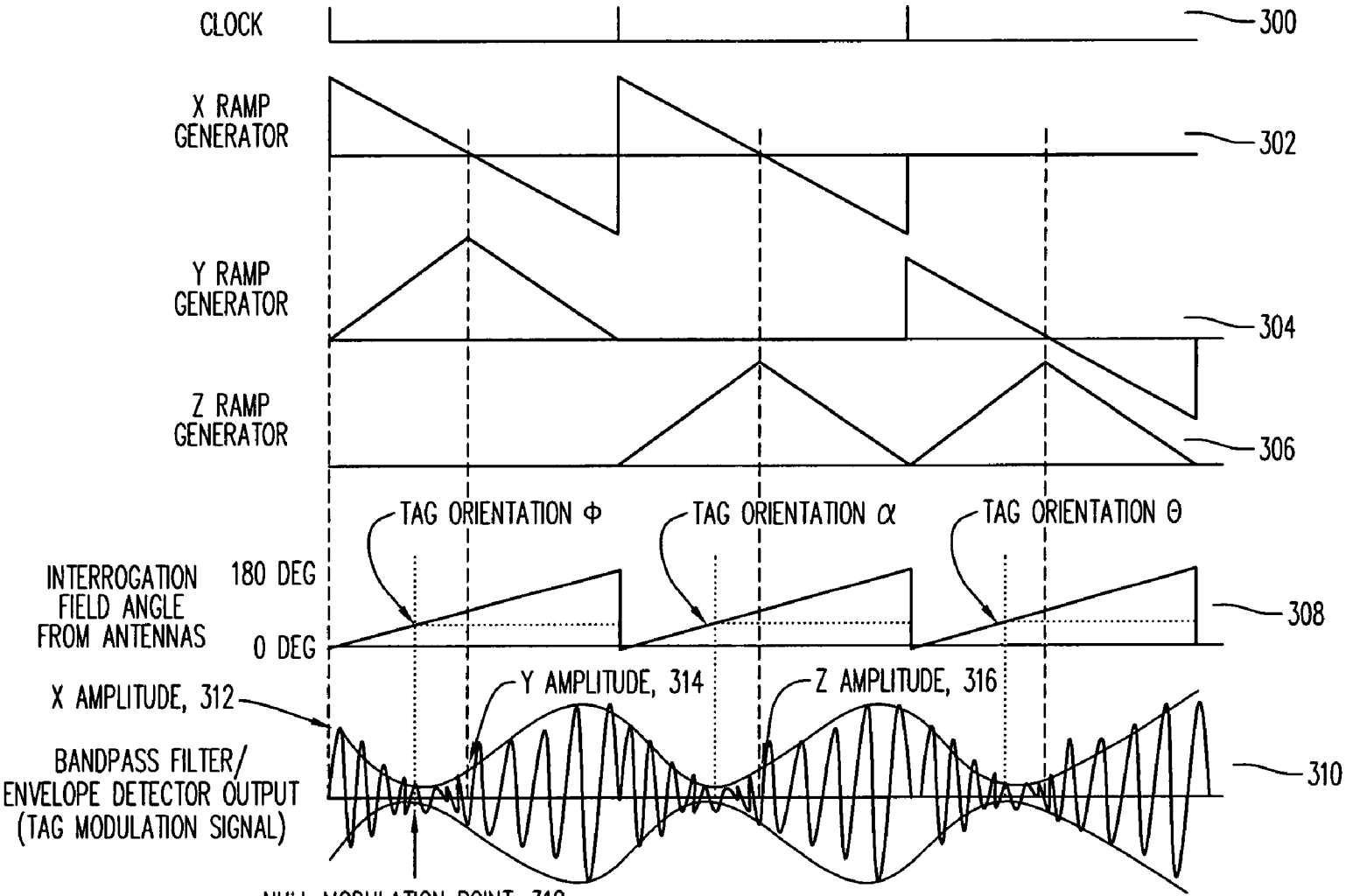
FIG. 4 is an illustration of example control signals for the RFID subsystem of FIG. 2.

FIG. 4 shows example control signals in six rows for subsystem 16. The first row 300 shows a clock signal. The second row 302 shows a signal from x ramp generator 108. The third row 304 shows a signal from y ramp generator 106. The fourth row 306 shows a signal from z ramp generator 108. The fifth row 308 shows an interrogation field angle from loop antennas 100 varying between about 0 and 180 degrees. In practice, the angle is not swept linearly, but during a calibration phase the field is measured to correct for nonlinearities in time and space. These corrections can be used to modify the ramp signals to produce a magnetic field angle that sweeps linearly with time. The sixth and last row 310 shows a bandpass filter/envelope detector output (tag modulation signal).

In some embodiments, the clock signal in first row 300 is a frame rate clock from video processing component 126. In some embodiments, the clock signal is dependent on how long it takes to read tagged item 20.

At the start of the first clock period, x ramp generator 108 is at full power, y ramp generator 106 is at zero, and z ramp generator 104 is at zero. Under these conditions, loop antenna 100 in the x-direction is excited and an x-amplitude tag modulation signal 312 (shown in row six 310) is read from receive chain 116. The x-amplitude of the inductive signal is used to correct for the x, y, and z offset and to get the x-co ordinate of the position (x, y, z) of tagged item 20.

About in the middle of the first clock period, y ramp generator 106 is at full power, x ramp generator 108 is at zero, and z ramp generator 104 is at zero. Under these conditions, loop antenna 100 in the y-direction is excited and a y-amplitude tag modulation signal 314 (shown in row six 310) is read from receive chain 116. The y-amplitude of the inductive signal is used to correct for the x, y, and z offset and to get the y-coordinate of the position (x, y, z) of tagged item 20.

About in the middle of the second clock period, z ramp generator 104 is at full power, x ramp generator 108 is at zero, and y ramp generator 106 is at zero. Under these conditions, loop antenna 100 in the z-direction is excited and a z-amplitude tag modulation signal 316 (shown in row six 310) is read from receive chain 116. The z-amplitude of the inductive signal is used to correct for the x, y, and z offset and to get the z-coordinate of the position (x, y, z) of tagged item 20. In some embodiments, the x-, y-, and z-coordinates are all read within one clock period, or about the time it takes to read tagged item 20.

As shown in row five 308, each angle in the orientation ($\Phi$, $\alpha$, $\theta$) is calculated at a tag modulation minimum (null) 318 (shown in row six 310). Angle $\Phi$ (phi) 200 is calculated, when an x-antenna signal is zero and tag modulation minimum 318 occurs. Angle $\theta$ (theta) 206 is calculated, when a z-antenna signal is zero and tag modulation minimum 318 occurs. Angle $\alpha$ (alpha) 210 is calculated, when a y-antenna signal is zero and tag modulation minimum 318 occurs.

Figure 5:
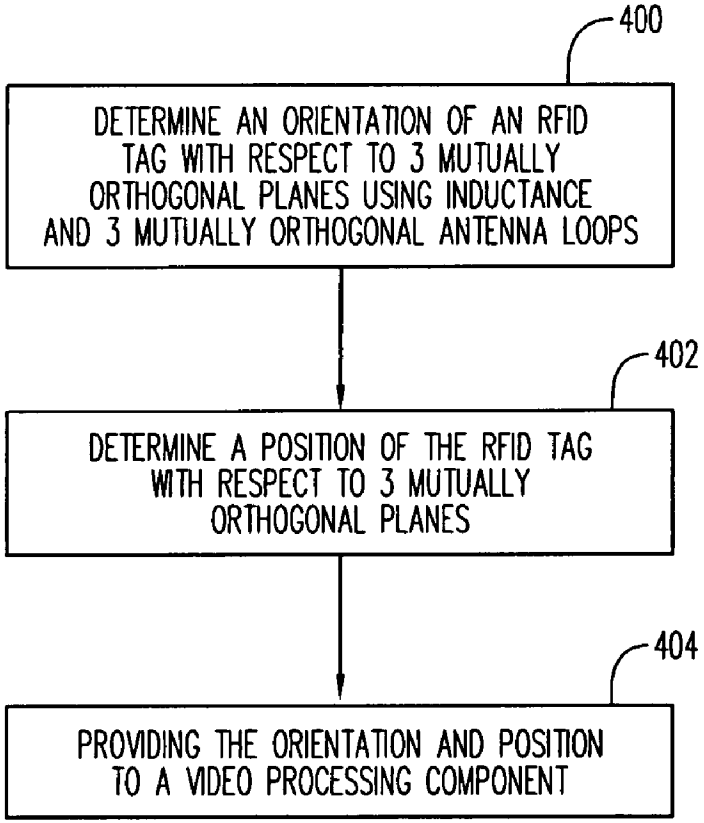
FIG. 5 is a flow chart of a first exemplary embodiment of a surveillance method.

FIG. 5 is a flow chart of an example surveillance method. In step 400, the orientation of tagged item 20 is determined with respect to three mutually orthogonal planes using inductance and three mutually orthogonal antenna loops. For example, $\Phi$ (phi) 200, $\theta$ (theta) 206, and $\alpha$ (alpha) 210 are determined with respect to the x-y, y-z, and z-x planes, as shown in FIG. 3. In step 402, the position of tagged item 20 is determined with respect to the three mutually orthogonal planes. For example, the x-, y-, and z-coordinates of the position (x, y, z) are determined at tag modulation minimum 318, as shown in row six 310 of FIG. 4. In step 404, the orientation and position of tagged item 20 is provided to a video-processing component.

Figure 6:
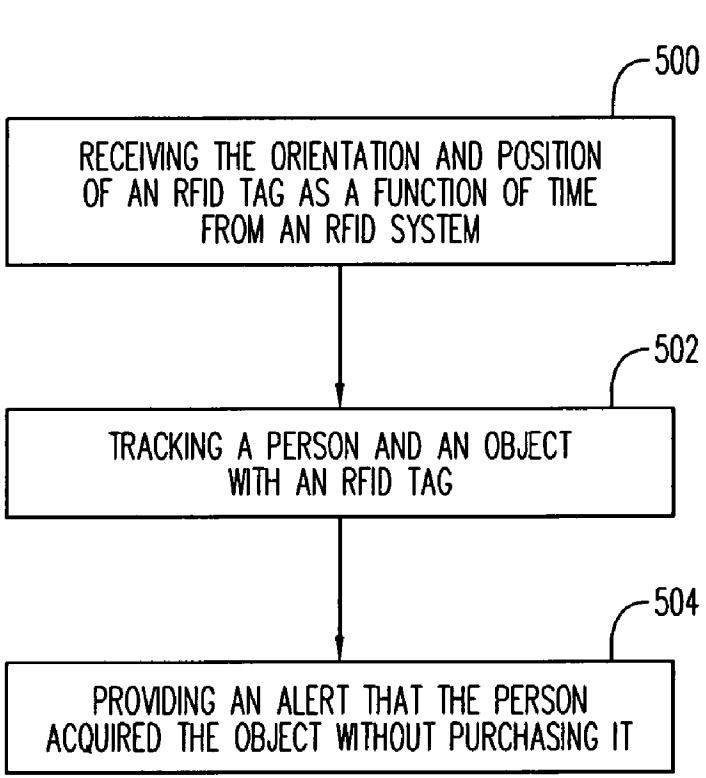
FIG. 6 is a flow chart of an alternate exemplary embodiment of a surveillance method.

FIG. 6 is a flow chart of another example surveillance method. In step 500, the orientation and position of tagged item 20 as a function of time is received from an RFID subsystem. In step 502, a person and an object with an RFID tag are tracked via a video subsystem. In step 504, an alert is provided indicating that the person acquired the object without purchasing it.

For example, suppose video processing component 126 recognizes a person stopping in front of a table displaying tagged item 20. Based on the video information from subsystem 18, RFID subsystem 16 is activated. As the person interacts with the tagged item 20, system 10 tracks hand motions, face motions, RFID information of the object and the like. If the person picks up the item, video subsystem 18 tracks the person within area 12 to establish whether the person placed the item down. For example, video subsystem 18 analyses the tracking of the person and the object, including object recognition and RFID. If the item was not placed anywhere then a strong hypothesis is built based on the interaction that the person still has the item. If so, a real-time alert is produced and a synopsis is provided, including salient video clips. In addition, a history of the person and object tracking is available.

Orientation information provided by RFID subsystem 16 to surveillance system 10 aids in analysis. For example, system 10 can analyze events, such as whether the object was placed in a shopping cart or handled in a secretive fashion using inputs from subsystems 16, 18. Another example is analyzing the appearance of tagged item 20. Here, surveillance system 10 can generate a synthesized appearance of the tagged item at the orientation provided by RFID subsystem 16. Surveillance system 10 can then compare the synthesized appearance with the actual appearance provided by video subsystem 18 to determine whether tagged item has been altered (e.g., authorized tampering).

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A surveillance system comprising:

a first loop antenna;

a second loop antenna substantially orthogonal to said first loop antenna, said first and second loop antennas being inductively couplable with a tag through magnetic fields;

a first attenuator driving said first loop antenna;

a second attenuator driving said second loop antenna;

a z ramp generator to provide a z control signal to said first attenuator;

a y ramp generator to provide a y control signal to said second attenuator;

a signal processing component for estimating an orientation of said tag based on a magnitude of an inductively coupled modulated signal from said tag as an orientation of a coupling field generated from said first and second loop antennas is scanned through a range of angles;

a splitter coupled to said signal processing component, wherein said signal processing component comprises:

a bandpass filter coupled to said splitter;

an envelope detector coupled to said bandpass filter;

a modulation minimum detector coupled to said envelope detector; and an angle calculator coupled to said modulation minimum detector, said angle calculator configured to estimate said orientation.

2. The system according to claim 1, further comprising: a third loop antenna substantially orthogonal to both said first and second loop antennas.

3. The system according to claim 2, further comprising: a third attenuator driving said third loop antenna.

4. The system according to claim 3, further comprising: an x ramp generator to provide a x control signal to said third attenuator.

5. The system according to claim 1, wherein said signal processing component is capable of estimating a position of said tag.

6. The system according to claim 1, further comprising: a video-processing component in communication with said signal-processing component to receive said orientation.

7. The system according to claim 6, wherein said video-processing component is capable of initiating surveillance when said tag is in an interrogation zone.

8. The system according to claim 6, wherein said video-processing component is capable of initiating surveillance when a person touches said tag.

9. The system according to claim 6, wherein said video processing component comprises:

a tracking mechanism;

an object verification mechanism; and a recognition mechanism.

10. A surveillance system comprising:

a first loop antenna;

a second loop antenna substantially orthogonal to said first loop antenna, said first and second loop antennas being inductively couplable with a tag through magnetic fields;

a first attenuator driving said first loop antenna;

a second attenuator driving said second loop antenna;

a z ramp generator to provide a z control signal to said first attenuator;

a y ramp generator to provide a y control signal to said second attenuator;

a signal processing component for estimating an orientation of said tag based on a magnitude of an inductively coupled modulated signal from said tag as an orientation of a coupling field generated from said first and second loop antennas is scanned through a range of angles;

a splitter coupled to said signal processing component; and a video-processing component in communication with said signal-processing component to receive said orientation, wherein said signal processing component comprises:

a bandpass filter coupled to said splitter;

an envelope detector coupled to said bandpass filter;

a modulation minimum detector coupled to said envelope detector;

an angle calculator coupled to said modulation minimum detector, said angle calculator configured to estimate said orientation.

11. The system according to claim 10, wherein said video-processing component is capable of initiating surveillance when said tag is in an interrogation zone.

12. The system according to claim 10, wherein said video-processing component is capable of initiating surveillance when a person touches said tag.

13. The system according to claim 10, wherein said video processing component comprises:

a tracking mechanism;

an object verification mechanism; and a recognition mechanism.

14. A surveillance system comprising:

a first loop antenna;

a second loop antenna substantially orthogonal to said first loop antenna, said first and second loop antennas being inductively couplable with a tag through magnetic fields;

a third loop antenna substantially orthogonal to both said first and second loop antennas;

a first attenuator driving said first loop antenna;

a second attenuator driving said second loop antenna;

a z ramp generator to provide a z control signal to said first attenuator;

a y ramp generator to provide a y control signal to said second attenuator;

a signal processing component for estimating an orientation of said tag based on a magnitude of an inductively coupled modulated signal from said tag as an orientation of a coupling field generated from said first and second loop antennas is scanned through a range of angles;

a splitter coupled to said signal processing component; and a video-processing component in communication with said signal-processing component to receive said orientation, wherein said signal processing component comprises:

a bandpass filter coupled to said splitter;

an envelope detector coupled to said bandpass filter;

a modulation minimum detector coupled to said envelope detector; and an angle calculator coupled to said modulation minimum detector, said angle calculator configured to estimate said orientation.

15. The system according to claim 14, further comprising: a third attenuator driving said third loop antenna.

16. The system according to claim 15, further comprising: an x ramp generator to provide a x control signal to said third attenuator.

* * * * *